US010329119B2

(12) United States Patent
Puranen et al.

(10) Patent No.: US 10,329,119 B2
(45) Date of Patent: Jun. 25, 2019

(54) ELEVATOR WITH CODE PATTERN TO DETERMINE CAR POSITION

(71) Applicant: KONE Corporation, Helsinki (FI)

(72) Inventors: Mikko Puranen, Riihimäki (FI); Pentti Alasentie, Espoo (FI)

(73) Assignee: KONE CORPORATION, Helsinki (FI)

( * ) Notice: Subject to any disclaimer, the term of this patent is extended or adjusted under 35 U.S.C. 154(b) by 476 days.

(21) Appl. No.: 15/091,285

(22) Filed: Apr. 5, 2016

(65) Prior Publication Data

US 2016/0311649 A1 Oct. 27, 2016

(30) Foreign Application Priority Data

Apr. 24, 2015 (EP) ..... 15164972

(51) Int. Cl.

| | |
|---|---|
| ***B66B 1/34*** | (2006.01) |
| ***B66B 5/00*** | (2006.01) |
| ***B66B 9/00*** | (2006.01) |
| *B66B 7/06* | (2006.01) |

(52) U.S. Cl.

CPC ..... *B66B 5/0018* (2013.01); *B66B 1/3492* (2013.01); *B66B 9/00* (2013.01); *B66B 7/062* (2013.01)

(58) Field of Classification Search

CPC ... B66B 5/0018; B66B 1/3492; B66B 5/0025; B66B 19/007; B66B 7/062; B66B 9/00; B66B 1/34

USPC ..... 187/247, 277, 391, 393, 394; 324/173, 324/207.2, 207.24, 219, 230; 340/547, 340/676

See application file for complete search history.

(56) References Cited

U.S. PATENT DOCUMENTS

| | | | | |
|---|---|---|---|---|
| 4,218,671 A * | 8/1980 | Lewis | B66B 1/3492 | 187/394 |
| 5,834,942 A * | 11/1998 | De Angelis | D07B 1/025 | 324/522 |
| 5,890,564 A * | 4/1999 | Olsen | B66B 7/123 | 187/250 |
| 6,454,054 B1 * | 9/2002 | Tanino | B66B 1/3492 | 187/394 |

(Continued)

FOREIGN PATENT DOCUMENTS

| | | |
|---|---|---|
| DE | 9210996 U1 | 10/1992 |
| EP | 2 546 181 A1 | 1/2013 |

(Continued)

*Primary Examiner* — Anthony J Salata

(74) *Attorney, Agent, or Firm* — Birch, Stewart, Kolasch & Birch, LLP

(57) ABSTRACT

An elevator including a hoistway, an elevator car vertically movable in the hoistway, a rope connected to the elevator car movably together with the elevator car, a guide for guiding the rope along a path and a device that determines a position of the elevator car. The device includes an elongated code mark pattern provided on the rope, one or more sensors mounted beside the rope for sensing code marks of the code mark pattern, and an analyzer connected with the a plurality of sensors. The one or more sensors sense code marks of the code mark pattern passing by them when the rope moves along its path, and the analyzer determines the current position of the elevator car based on code marks sensed by the one or more sensors during movement of the rope.

20 Claims, 6 Drawing Sheets

Legend
1 - elevator car
2 - counterweight
3, 4 - guiding means
6 - sensors
7 - analyzer
100 - elevator control
r, r' - rope
F - framework
H - hoistway
M - electric motor

(56) References Cited

U.S. PATENT DOCUMENTS

| | | | | |
|---|---|---|---|---|
| 6,651,781 | B2 * | 11/2003 | Lindegger | B66B 1/3492 187/286 |
| 6,886,667 | B2 * | 5/2005 | Kunz | B66B 1/3492 187/394 |
| 7,117,981 | B2 * | 10/2006 | Logan | B66B 7/1238 187/391 |
| 7,537,092 | B2 * | 5/2009 | Birrer | B66B 1/3492 187/391 |
| 7,540,357 | B2 * | 6/2009 | Finn | B66B 1/3492 187/394 |
| 7,857,106 | B2 * | 12/2010 | Zapf | B66B 7/062 187/394 |
| 7,938,233 | B2 * | 5/2011 | Kunz | B66B 1/3492 187/394 |
| 9,511,976 | B2 * | 12/2016 | Kang | B66B 1/3492 |
| 9,834,407 | B2 * | 12/2017 | Pelto-Huikko | B66B 1/3492 |
| 2006/0032711 | A1 | 2/2006 | Marchesi | |
| 2013/0015022 | A1 | 1/2013 | Sonnenmoser et al. | |

FOREIGN PATENT DOCUMENTS

| | | | |
|---|---|---|---|
| JP | 2000-351544 | A | 12/2000 |
| WO | WO 03/011733 | A1 | 2/2003 |
| WO | WO 2004/106209 | A1 | 12/2004 |

* cited by examiner

Legend

1 - elevator car

2 - counterweight 3, 4 - guiding means

6 - sensors

7 - analyzer

100 - elevator control r, r' - rope

F - framework

H - hoistway

M - electric motor

Legend

5 - code mark pattern

5a - code mark

6 - sensors

10 - load bearing members

11 - rope coating r, r' - rope

Legend

5 - code mark pattern

5a - code mark

6 - sensors

10 - load bearing members

11 - rope coating

11a - first coating portion

11b - second coating portion r, r' - rope s - strip

Legend

10 - load bearing members f - fibers m - matrix

Legend

5 - code mark pattern

5a - code mark

6 - sensors

7 - analyzer

ELEVATOR WITH CODE PATTERN TO DETERMINE CAR POSITION

FIELD OF THE INVENTION

The invention relates to an elevator for transporting passengers and/or goods, and in particular to determining position of the car thereof.

BACKGROUND OF THE INVENTION

In modern elevators, the position of the elevator car needs to be known for various reasons. For example, car position is typically used as a parameter based on which movement of the elevator car is controlled. There are various other uses for car position, such as uses related to safety and destination control algorithms.

In a conventional elevator, separate positioning switches are placed on each floor. These switches can indicate when the car is at their level and thereby position can be determined based on signals from said switches. In addition, elevators having long floor-to-floor—distances are provided with additional switches, so called dummy switches, in express zones that are between floors. This is the case for example with so called express or shuttle elevators.

Also such elevators have been proposed wherein the car position is determined based on encoded information. In US2006032711A1, a strip having a code mark pattern is placed to extend along a guide rail, which code mark pattern is read with a sensor device traveling with the car. An analyzer is provided for determining current car position based on the read code mark pattern. Closely related solutions are presented in WO03011733A1 and DE9210996U1. These solutions describe different alternative solutions for how the code mark pattern can be designed so that information can be read therefrom which enables determination of current position of the car. Said codes and alternative or corresponding codes are further known in general from encoder—devices. A drawback of these known solutions has been that a very long code pattern needs to be provided and installed accurately in the hoistway during installation process of the elevator. The installation process is time consuming as it needs to be done very accurately, and majority of the work needs to be performed at the installation site. Thereby, the installation process postpones completion of the new elevators and increases down time of the elevator being modernized.

In many elevator configurations it is difficult and laborious to fix the component comprising the code mark pattern in such a way that it is continuous and can be reliably sensed. Particularly, a drawback of known solutions is that the installation of the code mark pattern in the hoistway is challenging to carry out with good results, because the base on which the strip is to be added is difficult to make firm enough and immune to disturbances caused by car movement so that a reliable sensing can be obtained during movement of the car. For example, the guide rail lines are made of successive separate sections. Thereby, they are not firm and immune to disturbances, and thus provide a challenging base for the code mark pattern. Guide rail lines are also prone to deform during use of the elevator, whereby the code pattern is deformed as well.

BRIEF DESCRIPTION OF THE INVENTION

The object of the invention is to provide an elevator, which is improved in terms of its determination of current car position. An object is particularly to alleviate one or more of the above defined problems of prior art and/or problems discussed or implied elsewhere in the description. It is disclosed such advantageous embodiments, inter alia, wherein current car position is possible to be determined accurately without using numerous positioning switches placed in the hoistway. It is disclosed such advantageous embodiments, inter alia, wherein the solution is easy and swift to provide in an existing elevator or a new elevator, whereby completion time of a new elevator under construction is not harmfully postponed and the down time of an elevator being modernized can be kept short. It is disclosed such advantageous embodiments, inter alia, wherein the solution has good reliability.

It is brought forward a new elevator comprising an elevator car vertically movable in a hoistway; and a rope connected to the elevator car movably together with the elevator car, in particular such that it is moved when the elevator car moves. The elevator further comprises a guiding means, preferably in the form of one or more rope wheels, for guiding the rope along a path; and a means for determining position of the elevator car. Said means for determining position of the elevator car comprise an elongated code mark pattern provided on the rope, which elongated code mark pattern comprises code marks distributed along the length of the rope; and one or more sensors mounted beside the rope for sensing code marks of said code mark pattern; and an analyzer connected with the at least one sensor. The code marks are arranged to pass by said one or more sensors mounted beside the rope when the rope moves along its path. The one or more sensors are arranged to sense code marks of the code mark pattern passing by them when the rope moves along its path, and said analyzer is configured to determine current position of the elevator car based on code marks sensed by the one or more sensors during the movement of the rope along its path. Hereby, one or more of the above mentioned objects and advantages can be achieved.

In a preferred embodiment, the one or more sensors are mounted on a stationary structure of the elevator, such as on a structure fixed on the building in which the elevator is installed. It is particularly preferable that the one or more sensors are mounted on the frame of the machinery of the elevator. Thus the sensors can be easily positioned relative to rope path, and furthermore in a position close to rope wheels where the rope runs steadily without fluctuation. Thus, the sensors can be swiftly and accurately installed.

In a preferred embodiment, each said sensor is arranged to generate a sensor signal representing sensed code marks. Said code mark pattern is formed to be such that the sensor signal generated by said one or more sensor can be interpreted by the analyzer for the determination of current car position.

In a preferred embodiment, the elevator comprises a suspension roping suspending the elevator car comprising one or more suspension ropes and said rope r is one of said suspension ropes. Said suspension ropes can be arranged to interconnect the counterweight and the car. In this context, it is particularly preferable that the ropes are formed to have a specifically high tensile stiffness so as to reduce deformation of the rope under load. For this purpose, the rope is preferably a composite rope as described elsewhere in the application.

In a preferred embodiment, the rope is a rope not suspending the car and interconnecting the counterweight and the car, hanging from these, and passing around a rope wheel mounted in the lower end of the hoistway. In this context, the rope is not brought under great load during normal elevator use. Thereby, challenges with regard to rope elongation are in this context only slight. In this context, the rope elongation can be practically eliminated by forming the ropes to have a specifically high tensile stiffness. For this purpose, the rope is preferably a composite rope as described elsewhere in the application.

In a preferred embodiment, the rope comprises one or more load bearing members extending parallel to the longitudinal direction of the rope unbroken throughout the length of the rope.

In a preferred embodiment, the one or more load bearing members are made of composite material comprising reinforcing fibers embedded in polymer matrix, which reinforcing fibers are carbon fibers. Hereby, obtaining a high stiffness for the rope is facilitated as carbon fibers provide excellent stiffness. Making the rope stiff reduces gives it low elongation under tensile stress. Thereby, determining position by the code pattern of the rope is feasible in terms of its accuracy, as it is not sensitive to deformation of the pattern.

In a preferred embodiment, the reinforcing fibers are substantially untwisted relative to each other. Hereby, obtaining a high stiffness for the rope can be facilitated. Hereby, the structure is in contrast to twisted structure very straight and stiffness of the rope is facilitated as no straightening of the bearing components takes place when the rope is pulled. Making the rope stiff reduces gives it low elongation under tensile stress. Thereby, determining position by the code pattern of the rope is feasible in terms of its accuracy, as it is not sensitive to deformation of the pattern.

In a preferred embodiment, said one or more load bearing members as well as said reinforcing fibers are oriented parallel with longitudinal direction of the rope. Hereby, the structure is straight and obtaining of a high stiffness for the rope is facilitated as no straightening of the bearing components takes place when the rope is pulled. Making the rope stiff reduces gives it low elongation under tensile stress. Thereby, determining position by the code pattern of the rope is feasible in terms of its accuracy, as it is not sensitive to deformation of the pattern.

In a preferred embodiment, the reinforcing fibers of each load bearing member are substantially evenly distributed in the polymer matrix of the load bearing member in question. Preferably, over 50% of the cross-sectional square area of the load bearing member consists of said reinforcing fibers.

In a preferred embodiment, the rope is belt-shaped, whereby it is substantially larger in its width direction than in thickness direction. The rope being belt-shaped, the rope's attitude can be controlled easily such that the code marks are correctly positioned relative to the sensor(s). The rope being belt-shaped it has opposing wide sides. The elongated pattern of code marks is provided on one of the wide sides of the rope. On a wide side, the code mark pattern is easy to provide, and in this position it can be simply sensed by the one or more sensor.

In a preferred embodiment, the guiding means comprise one or more rope wheels around which the rope is arranged to pass turning around an axis extending in width direction of the rope. The rope has then its wide side resting against the circumference of each said rope wheel. Thereby the rope's attitude can be ensured easily such that the code marks are correctly positioned relative to the sensor(s).

In a preferred embodiment, said one or more sensors are focused on the wide side of the belt-shaped rope to sense code marks provided thereon.

In a preferred embodiment, the rope has width per thickness ratio W/T more than 2. Thereby the rope's attitude can be ensured easily such that the code marks are correctly positioned relative to the sensor(s).

In a preferred embodiment, the wide side of the belt-shaped rope and said one or more sensors are arranged to face each other.

In a preferred embodiment, said one or more load bearing members are embedded in a coating. Preferably, said coating is a polymer coating, preferably made of one or more polymer material, such as of polyurethane.

In a preferred embodiment, said code mark pattern is comprised in an elongated code mark strip comprised in the rope. The strip is then an element whereto the code marks are provided, and which element is provided on the rope. In one preferred implementation, the strip is attached on the outer surface of the coating of the rope wherein the load bearing members are embedded. In one other preferred implementation, the strip is embedded in the coating of the rope. The strip can then be embedded in the same uniform coating material with the load bearing members, whereby the rope structure formed is simple and easy to manufacture. As an alternative, the rope can be such that the coating of the rope comprises a first coating portion and a second coating portion, and the one or more load bearing members are embedded in the first coating portion, and the strip is provided outside the first coating portion and covered by the second coating portion that is outside the first coating portion. With the coating, the strip as well as the code mark pattern thereof, are well protected during shipping, installation and use, whereby swift and easy installation as well as reliability of the car positioning are facilitated.

In a preferred embodiment, the coating is transparent such that the strip visible from outside the rope through said coating. Thus, condition and position of the strip and the code marks is simple to inspect. Thus, the rope provided with the code mark pattern can be recognized simply. The sensor structure can also be formed to be based on optical sensing.

In a preferred embodiment, the strip is positioned between the outer face of the coating of the rope and one or more load bearing members of the rope.

In a preferred embodiment, the rope is belt-shaped, whereby it is substantially larger in width direction than in thickness direction, and the elongated code mark pattern, in particular the strip, is provided on the wide side of the rope, and the guiding means comprise one or more rope wheels around which the rope is arranged to pass turning around an axis extending in width direction of the rope, the same wide side of the rope resting against the circumference of each rope wheel around which the rope passes, which same wide side of the rope is opposite the side on which the elongated pattern of code marks is provided. Thereby, the code mark pattern is on the side of the rope which is not in direct contact with the rope wheels, whereby it is protected from the greatest internal stresses caused by the contact forces between the rope and the rope wheels. Thus, its endurance can be extended. It is then also preferable that the rope is belt-shaped whereby the attitude is easily controllable to be as intended. It is further preferable, that the one or more load bearing members of the rope are positioned between the elongated pattern of code marks, in particular the strip comprising them, and the wide side of the rope which rests against the circumference of each of said rope wheels. Then, the stresses experienced by the code mark pattern, and in particular the strip in case the pattern is comprised in this kind of element, can be reduced to so slight that implementation with solutions inducing great internal stresses in the rope is greatly facilitated. This is the case particularly in case the rope is a suspension rope of the elevator.

In a preferred embodiment, the rope is belt-shaped and the guiding means comprise one or more rope wheels around which the rope is arranged to pass turning around an axis extending in width direction of the rope, and the rope is arranged to turn around all the rope wheels only in the same direction. Thus, no reverse bending takes place and rope contact with one wide side of the rope can be fully avoided. Thus, the advantages described in the previous paragraph can be greatly facilitated.

In a preferred embodiment, the guiding means comprise one or more rope wheels around which the rope is arranged to pass turning around an axis extending in width direction of the rope, and said one or more sensors are focused to sense code marks provided on a section of the rope resting against the rope wheel.

In a preferred embodiment, said one or more sensors are positioned on the radial side of the rope wheel such that the rope passes between said one or more sensors and the rope wheel.

In a preferred embodiment, the code marks include optical and/or magnetic code marks. The optical code marks can be printed on the strip or directly on coating or other component of the rope in case the code marks are intended to be provided without a strip component. The magnetic code marks are preferably provided by including a strip comprising magnetic code marks in the rope.

In a preferred embodiment, the code mark pattern and the one or more sensors are configured to function together as an incremental encoder or as an absolute encoder.

In a preferred embodiment, for determining current car position based on code marks sensed by the one or more sensors during said movement of the rope the analyzing means are configured to obtain a car reference position, such as an earlier position, e.g. from a position sensor directly sensing car position; and to determine change in car position based on code marks sensed by the sensing device during rope movement; and to sum up said change in car position and the car reference position.

In a preferred embodiment, the analyzing means is configured to obtain the car reference position from a position sensor directly sensing car position. Thus, the function of the process of determining position can be monitored during use of the elevator, and easily calibrated. Hereby, safety and accuracy of the system can be ensured.

In a preferred embodiment, said code mark pattern comprises one or more series of code marks distributed along the length of a rope. Said one or more series can include comprises more than one series of code marks distributed along the length of a rope adjacent each other in width direction of the rope.

Said elevator is preferably an elevator for transporting passengers and/or goods. For this purpose, the elevator comprises a car that has an interior space suitable for receiving a passenger or passengers and/or load to be lifted. The elevator is preferably such that the car thereof is arranged to serve two or more landings. The elevator preferably controls movement of the car in response to calls from landing and/or destination commands from inside the car so as to serve persons on the landing(s) and/or inside the elevator car.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
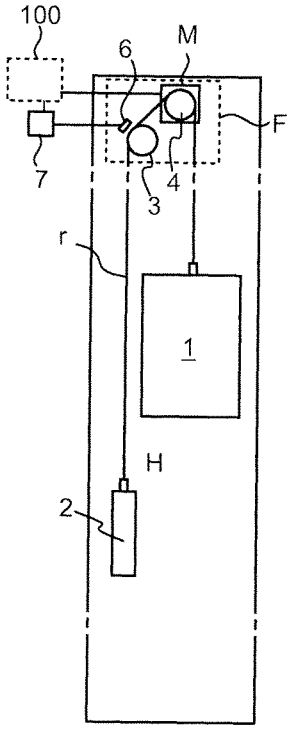
FIG. 1 illustrates an elevator according to a first preferred embodiment.
Figure 3:
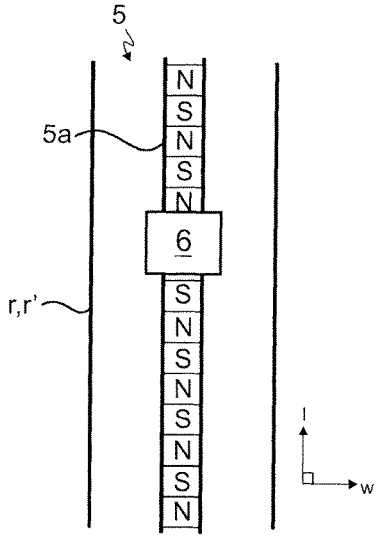
FIG. 3 illustrates means for determining position of the elevator car.

FIG. 1 illustrates an elevator according to a first preferred embodiment. The elevator comprises a hoistway H, and an elevator car 1 and a counterweight 2 vertically movable in the hoistway H. The car 1 and the counterweight 2 are interconnected by at least one suspension rope r. Thus, each of said the at least one rope r is a suspension rope suspending said car 1 and counterweight 2. The elevator further comprises guiding means 3,4, in the form of one or more rope wheels (here two), for guiding each said rope r along a path. Each said rope r is connected to the elevator car 1, whereby it is movable together with the elevator car 1. For determining current position of the elevator car 1, the elevator is provided with means 5, 5*a*, 6, 7 for determining position of the elevator car 1. Said means 5, 5*a*, 6, 7 for determining position of the elevator car 1 comprise an elongated code mark pattern 5 provided on the rope r, which elongated code mark pattern 5 comprises code marks 5*a* distributed along the length of the rope. Said means further comprise one or more sensors 6 mounted beside the rope r for sensing code marks 5*a* of said code mark pattern 5 as illustrated in FIG. 3. Said means further comprise an analyzer 7 connected with the one or more sensors 6. The code marks 5*a* are arranged to pass by said one or more sensors 6 mounted beside the rope r when the rope r moves along its path, and the one or more sensors 6 are arranged to sense code marks 5*a* passing by them when the rope r moves along its path, and said analyzer 7 is configured to determine current position of the elevator car 1 based on code marks 5*a* sensed by the one or more sensors 6 during movement of the rope r. Each said sensor 6 is arranged to generate a sensor signal representing sensed code marks 5*a*. Said mark pattern 5 is formed to be such that the sensor signal generated by said one or more sensor 6 can be interpreted by the analyzer 7 for said determination of current car position. This can be implemented in multiple alternative ways, for example in any way known from the prior art, such as from encoder devices or the aforementioned pieces of prior art, for example.

Figure 2:
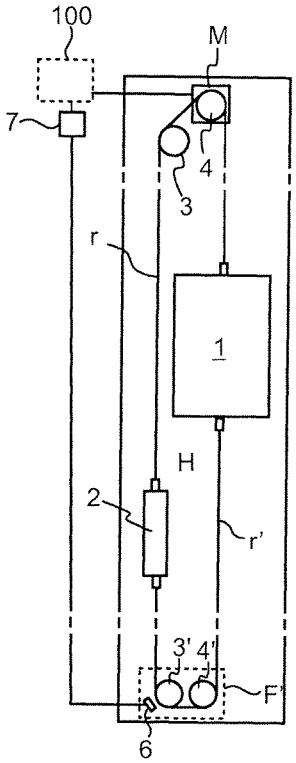
FIG. 2 illustrates an elevator according to a second preferred embodiment.

FIG. 2 illustrates an elevator according to a second preferred embodiment. The elevator comprises a hoistway H, and an elevator car 1 and a counterweight 2 vertically movable in the hoistway H. The car 1 and the counterweight 2 are interconnected by at least one suspension rope r, as described in context of FIG. 1. The elevator further comprises at least one rope r' interconnecting the car or counterweight but not suspending either of them. The rope r' hangs from the car 1 and counterweight. The elevator further comprises guiding means 3,4, in the form of rope wheels (here two), for guiding each said rope r along a path. In the presented case, the rope r' passes around said one or more rope wheels 3',4' which are mounted in the lower end of the hoistway H. Each said rope r' is connected to the elevator car 1, whereby it is movable together with the elevator car 1. For determining current position of the elevator car 1, the elevator is provided with means 5, 5*a*, 6, 7 for determining position of the elevator car 1. Said means 5, 5*a*, 6, 7 for determining position of the elevator car 1 comprise an elongated code mark pattern 5 provided on the rope r', which elongated code mark pattern 5 comprises code marks 5*a* distributed along the length of the rope. Thus, in this embodiment said pattern is provided on the rope r' not suspending said car or counterweight 2. Said means further comprise one or more sensors 6 mounted beside the rope r' for sensing code marks 5*a* of said pattern 5 of code marks 5*a*, as illustrated in FIG. 3. Said means further comprise an analyzer 7 connected with the one or more sensors 6. The code marks 5*a* are arranged to pass by said one or more sensors 6 mounted beside the rope r' when the rope r' moves along its path, and the one or more sensors 6 are arranged to sense code marks 5*a* passing by them when the rope r' moves along its path, and said analyzer 7 is configured to determine current position of the elevator car 1 based on code marks 5*a* sensed by the one or more sensors 6 during movement of the rope r'. Each said sensor 6 is arranged to generate a sensor signal representing sensed code marks 5*a*. Said mark pattern 5 is formed to be such that the sensor signal generated by said one or more sensor 6 can be interpreted by the analyzer 7 for said determination of current car position. This can be implemented in multiple alternative ways, as mentioned above.

In embodiments of FIGS. 1 and 2, the elevator further comprises an elevator control 100 for automatically controlling movement of the elevator car 1, in particular by controlling an electric motor M arranged to rotate a drive wheel 4 around which ropes r connected with the elevator car 1 pass. The analyzer 7 is connected with said elevator control 100. Data indicating the determined current position of the elevator car can thus be passed to the elevator control 100. The elevator control 100 is arranged to use this data for one or more purposes. For example, the elevator control 100 can use it for determining speed of the car. In particular, the elevator control 100 can use it as a control parameter. The elevator control 100 can use it as a control parameter for controlling car movement such as deceleration of the car when it is being stopped at a landing. Additionally or alternatively, the elevator control 100 can used to accurately position the car 1 at the landings of the elevator.

In embodiments of FIGS. 1 and 2, the one or more sensors are mounted on a stationary structure of the elevator, which is a structure fixed on the building in which the elevator is installed. In FIG. 1, the one or more sensors are particularly mounted on the framework F of the machinery of the s elevator including the motor M. In FIG. 2, the one or more sensors are particularly mounted on the framework F' of the one or more rope wheels 3',4'.

Figure 4:
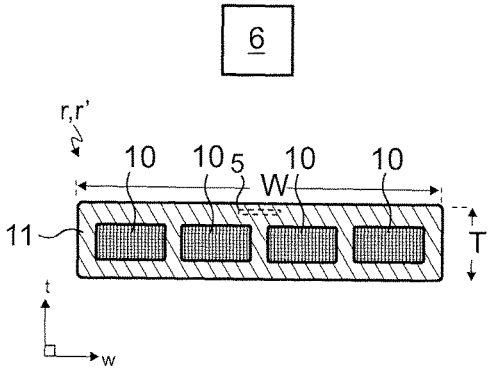
FIG. 4 illustrates a preferred shape for the rope.

FIG. 4 illustrates a preferred shape for the rope r,r'. As presented, the rope r, r' is belt-shaped, whereby it is substantially larger in width direction w than in thickness direction t, as measured in transverse direction of the rope. The rope has then two opposing wide sides, both having a face facing in thickness direction, and two opposing slim sides forming the flanks of the rope both having a face facing in width direction w of the rope. The elongated code mark pattern 5 is provided on the wide side of the rope r,r'. This is preferably implemented as illustrated in any of the FIGS. 5 to 7 each presenting an enlarged view of FIG. 4 each presenting a preferable alternative implementation.

Referring to FIG. 3, it is preferable that said one or more sensors are focused on the wide side of the belt-shaped rope (i.e. the side having a face extending in width direction w of the rope and facing in thickness direction t of the rope r,r') to sense code marks of the pattern 5 provided thereon. For this purpose, the wide side of the belt-shaped rope and said one or more sensors are arranged to face each other. The rope r,r' has preferably width per thickness ratio W/T more than 2, whereby its attitude can be ensured easily such that the code marks are correctly positioned relative to the sensor(s). FIG. 3 illustrates one type of pattern 5, particularly utilizing magnetic code marks 5*a*, but the pattern could alternatively be of some other type known or mentioned in the application, such as one of those disclosed in FIGS. 11-13.

The guiding means 3,4;3',4' preferably comprise one or more rope wheels around which the rope r,r' is arranged to pass turning around an axis extending in width direction of the rope. Thereby rope's attitude can be ensured easily such that the code marks are correctly positioned relative to the sensor(s), which is particularly facilitated if the rope is belt-shaped.

Said one or more sensors can be focused to sense code marks provided on a section of the rope resting against the rope wheel (3,3'), as illustrated in FIGS. 1 and 2. This is advantageous, as in this way the relative position of the sensors and the fast moving rope can be controlled efficiently. Otherwise small clearance between the sensor(s) and the rope, in particular the code marks thereof, could be difficult to provide as free sections of the rope are prone to flutter during rope movement. It is then preferable that said one or more sensors is/are positioned on the radial side of the rope wheel (3,3') such that the rope passes between said one or more sensors and the rope wheel 3,3'.

FIG. 4 also illustrates a preferred internal structure for the rope r,r'. That is, the rope r,r' comprises one or more load bearing members 10 embedded in a coating 11 and extending parallel to the longitudinal direction of the rope r,r' unbroken throughout the length of the rope r,r'. In the example presented in FIG. 4, there are plurality, in particular four, of said load bearing members 10 embedded in a common coating 11. Preferably, said coating 11 is made of one or more polymer material, such as of polyurethane. The coating 11 is preferably elastic. Each said load bearing member 10 is preferably made material of low elongation under tensile stress. As a result, also the rope r,r' has low elongation under tensile stress. Thereby, determining position by the code pattern 5 of the rope r,r' is feasible in terms of its accuracy. With ropes prone to stretching under load, accurate determination of car position would be exteremely difficult as load changes and car position changes would cause changes in rope length and the pattern thereby being deformed constantly during use of the elevator. For the purpose of alleviating this challenge, it is particularly preferable that of each said load bearing member 10 is made of composite material comprising reinforcing fibers f embedded in polymer matrix m, which reinforcing fibers f are carbon fibers, and said one or more load bearing members 10 as well as said reinforcing fibers f are parallel with longitudinal direction of the rope r,r'. The preferred further details of the structure and properties of the load bearing members 10 will be described further in context of FIGS. 8 and 9.

Figure 5:
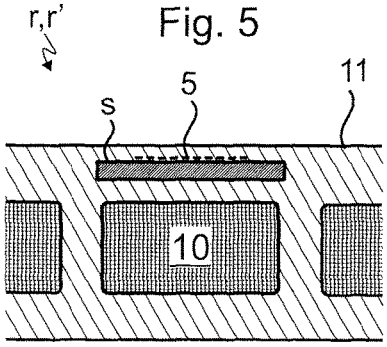
FIGS. 5 to 7 each illustrate an enlarged view of FIG. 4 each representing a preferable alternative for providing the elongated code mark pattern on the rope.
Figure 6:
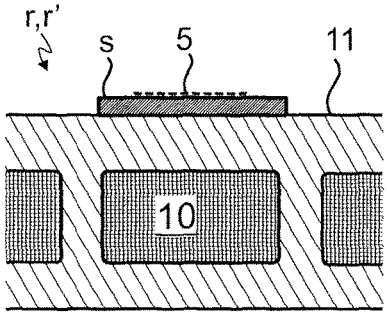
Figure 7:
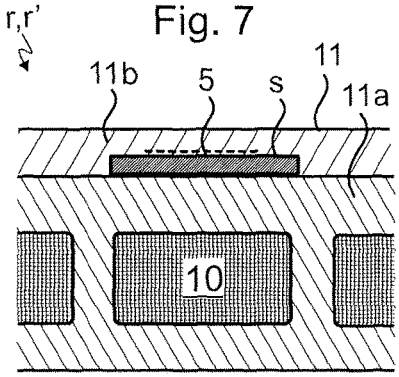

As presented in FIGS. 5 to 7, it is preferable that said code mark pattern 5 is comprised in an elongated code mark strip s comprised in the rope r,r'. The strip s extends along the length of the rope r,r', preferably the whole length thereof.

In the implementation presented in FIG. 5, the strip s is embedded in the coating 11 of the rope. The coating 11 is preferably transparent such that the strip s is visible from outside the rope through said coating 11. As illustrated, it is preferable that in this implementation the strip s is positioned between the outer face of the coating 11 which faces in thickness direction t and a load bearing member 10 of the rope. Further, it is preferable that the strip s is embedded in the same uniform coating material with the one or more load bearing members 10 of the rope.

In the implementation presented in FIG. 6, the strip is attached on the outer surface of the coating 11 of the rope r,r'.

In the implementation presented in FIG. 7, the strip s is embedded in the coating 11 of the rope r,r'. In this implementation, the coating 11 of the rope comprises a first coating portion 11*a* and a second coating portion, which may be of the same material or different materials. The load bearing members 10 are embedded in the first coating portion 11*a*, and the strip s is provided outside the first coating portion 11*a* and covered by the second coating portion 11*b* that is outside the first coating portion 11*a*. It is preferable that the coating 11 is transparent such that the strip s is visible from outside the rope through said coating 11, and in particular it is preferable that at least said second coating portion 11*b* is transparent such that strip is visible from outside the rope through said second coating portion 11*b*.

Figure 10:
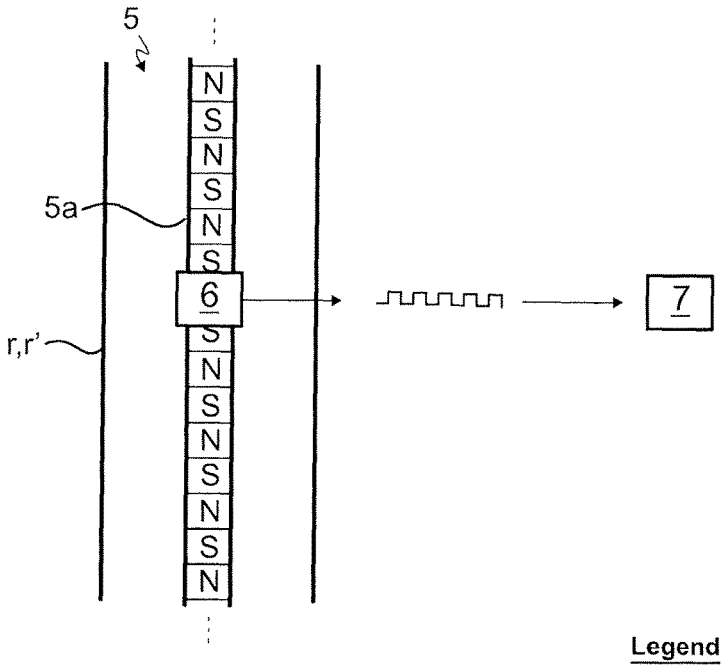
FIGS. 10 and 11 illustrate a pattern wherein the code marks are magnetic code marks.
Figure 11:
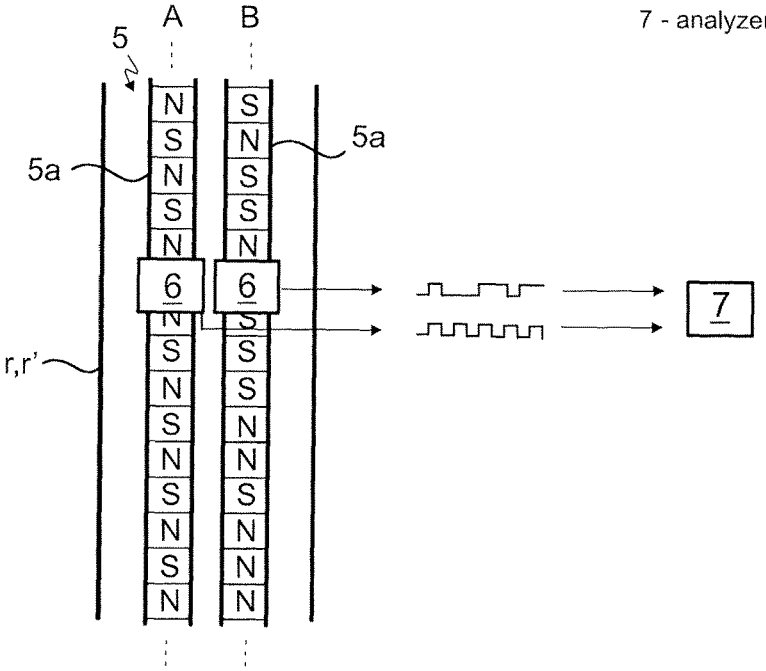
Figure 12:
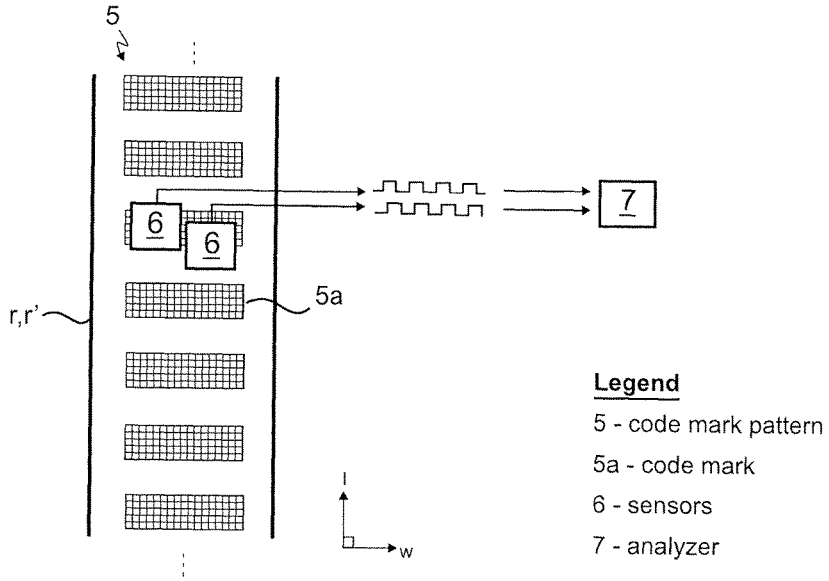
FIGS. 12 and 13 illustrate a pattern wherein the code marks are optical code marks.
Figure 13:
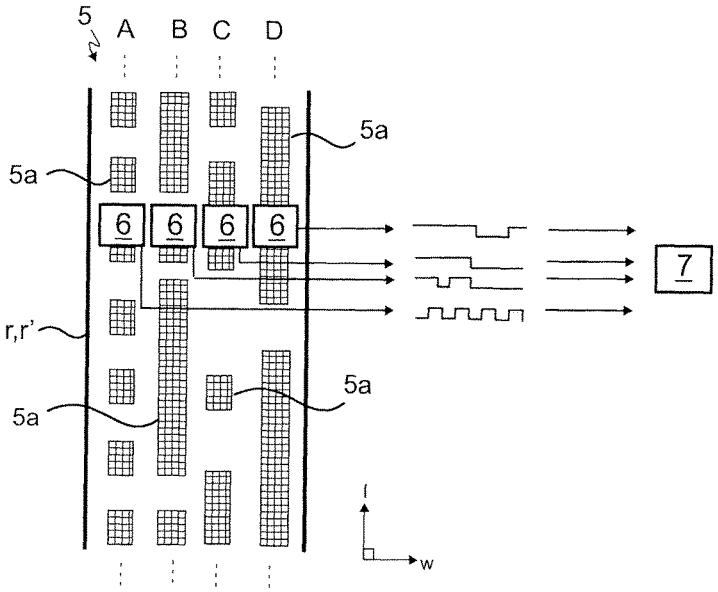

The code marks of the code pattern can include optical and/or magnetic code marks. Both kinds are known to be used in encoders, such as in rotary encoders used for position detection of rotating components generally and for position detection of rotating motor components in elevators. Both kinds are known to be used in linear encoders. In case magnetic code marks are to be utilized, the magnetic code marks are preferably provided by including a strip s comprising magnetic code marks in the rope. FIGS. 3, 10 and 11 illustrate a pattern wherein the code marks 5*a* are magnetic code marks. In this case, the code marks are each of the type having a magnetic south pole S or a magnetic north pole N facing the side of the rope r,r' on which side the sensor(s) 6 is/are located. In case optical code marks are to be utilized, the optical code marks can be printed on the strip s or directly on the coating 11 or on some other component of the rope r,r' if the code marks are intended to be provided without a strip component. FIGS. 12 and 13 illustrate a pattern 5 wherein the code marks 5*a* are optical code marks.

As mentioned, it is preferable, that the rope r,r' has low elongation under tensile stress. For this end, it is made very stiff in its longitudinal direction I. For this purpose, the rope comprises one or more load bearing member(s) 10 oriented parallel with the longitudinal direction of the rope r,r'. Furthermore, the material is chosen to be stiff. For this purpose, each of said one or more load bearing member(s) 10 is made of composite material, which composite material comprises reinforcing fibers f embedded in polymer matrix m, which reinforcing fibers f are carbon fibers. Carbon fibers have a very high tensile stiffness whereby also composite material reinforced by this fiber has excellent stiffness, particularly when the fibers are oriented parallel with the direction of the tension. Accordingly, to further facilitate stiffness, said reinforcing fibers f are preferably oriented parallel with the longitudinal direction of the rope r,r'. Due to the straight overall structure and the particular material selection for the fibers, the load bearing member(s) of the rope is/are extremely stiff in the longitudinal direction of the rope making also the complete rope r,r' very stiff in its longitudinal direction I. With this structure, the rope formed is stiff enough in its longitudinal direction to make it feasible to utilize the code pattern 5 provided on the rope r,r' for determining position of the car.

Figure 8:
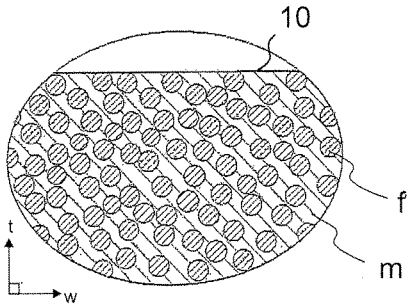
FIGS. 8 to 9 illustrate preferred further details of the structure of the load bearing members of the rope.
Figure 9:
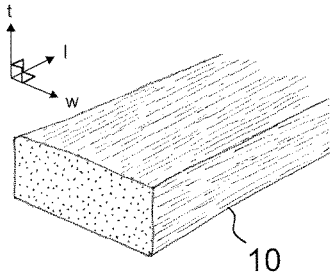

FIGS. 8 and 9 illustrate preferable features for the load bearing member(s) 10. In particular, FIG. 8 illustrates three-dimensionally the preferred structure of the load bearing member 10 and FIG. 9 illustrates the preferred inner structure of the load bearing member 10, disclosing in particular the cross section of the cross-section of the load bearing member 10 as viewed in the longitudinal direction I of the load bearing member 10. The load bearing member 10 is made of composite material comprising reinforcing fibers f embedded in polymeric matrix m. Each load bearing member 10 is a rod elongated in and parallel with the longitudinal direction I of the rope r,r'. The fibers f are parallel with the longitudinal direction of the load bearing member 10, and the load bearing member 10 is oriented parallel with the length direction of the rope. Thereby, the fibers are aligned with the force when the rope is pulled, which ensures that the structure provides high tensile stiffness as no meaningful fiber straightening can take place when the rope is put under tension. The fibers f of the rope r,r' used in the preferred embodiments are substantially untwisted in relation to each other, which provides them said orientation parallel with the longitudinal direction of the rope. This is in contrast to the conventionally twisted elevator ropes, where the wires or fibers are strongly twisted and have normally a twisting angle from 15 up to 30 degrees, the fiber/wire bundles of these conventionally twisted elevator ropes thereby having the potential for transforming towards a straighter configuration under tension, which provides these ropes a high elongation under tension. The preferred inner structure of the load bearing member 10 is more specifically as follows. The load bearing member 10, as well as its fibers f are parallel with the longitudinal direction the rope, and untwisted as far as possible. Individual reinforcing fibers f are bound into a uniform load bearing member with the polymer matrix m. Thus, each load bearing member 10 is one solid elongated rod-like piece. The reinforcing fibers f are preferably long continuous fibers in the longitudinal direction of the rope r,r', the fibers f preferably continuing for the whole length of the load bearing member 10 as well as the rope r,r'. The reinforcing fibers f are preferably distributed in the aforementioned load bearing member 10 as evenly as possible, so that the load bearing member 10 would be as homogeneous as possible in the transverse direction of the rope. An advantage of the structure presented is that the matrix m surrounding the reinforcing fibers f keeps the interpositioning of the reinforcing fibers f substantially unchanged. It equalizes with its slight elasticity the distribution of a force exerted on the fibers, reduces fiber-fiber contacts and internal wear of the rope, thus improving the service life of the rope. The composite matrix m, into which the individual fibers f are distributed as evenly as possible, is most preferably of epoxy, which has good adhesiveness to the reinforcement fibers f and which is known to behave advantageously with carbon fiber. Alternatively, e.g. polyester or vinyl ester can be used, but alternatively any other suitable alternative materials can be used. FIG. 9 presents a partial cross-section of the load bearing member 10 close to the surface thereof as viewed in the longitudinal direction of the rope presented inside the circle in the figure, according to which cross-section the reinforcing fibers f of the load bearing member s 10 are preferably organized in the polymer matrix m. The rest (not showed parts) of the load bearing member 10 have a similar structure. FIG. 9 presents also how the individual reinforcing fibers f are substantially evenly distributed in the polymer matrix m, which surrounds the fibers and which is fixed to the fibers f. The polymer matrix m fills the areas between individual reinforcing fibers f and binds substantially all the reinforcing fibers f that are inside the matrix m to each other as a uniform solid substance. A chemical bond exists between, preferably all, the individual reinforcing fibers f and the matrix m, one advantage of which is uniformity of the structure. To strengthen the chemical bond, there can be, but not necessarily, a coating (not presented) of the actual fibers between the reinforcing fibers and the polymer matrix m. The polymer matrix m is of the kind described elsewhere in this application and can thus comprise additives for fine-tuning the properties of the matrix as an addition to the base polymer. The polymer matrix m is preferably of a hard non-elastomer. The reinforcing fibers f being in the polymer matrix means here that the individual reinforcing fibers are bound to each other with a polymer matrix m, e.g. in the manufacturing phase by immersing them together in the fluid material of the polymer matrix. In this case the gaps of individual reinforcing fibers bound to each other with the polymer matrix comprise the polymer of the matrix. In this way a great number of reinforcing fibers bound to each other in the longitudinal direction of the rope are distributed in the polymer matrix. The reinforcing fibers are preferably distributed substantially evenly in the polymer matrix such that the load bearing member is as homogeneous as possible when viewed in the direction of the cross-section of the rope. In other words, the fiber density in the cross-section of the load bearing member does not therefore vary substantially. The reinforcing fibers f together with the matrix m form a uniform load bearing member, inside which abrasive relative movement does not occur when the rope is bent. The individual reinforcing fibers of the load bearing member 10 are mainly surrounded with polymer matrix m, but random fiber-fiber contacts can occur because controlling the position of the fibers in relation to each other in their simultaneous impregnation with polymer is difficult, and on the other hand, perfect elimination of random fiber-fiber contacts is not necessary from the viewpoint of the functioning of the invention. If, however, it is desired to reduce their random occurrence, the individual reinforcing fibers f can be pre-coated such that a polymer coating is around them already before the binding of individual reinforcing fibers to each other. In the invention the individual reinforcing fibers of the load bearing member can comprise material of the polymer matrix around them such that the polymer matrix is immediately against the reinforcing fiber but alternatively a thin coating, e.g. a primer arranged on the surface of the reinforcing fiber in the manufacturing phase to improve chemical adhesion to the matrix material, can be in between. Individual reinforcing fibers are distributed evenly in the load bearing member 10 such that the gaps of individual reinforcing fibers f are filled with the polymer of the matrix m. Most preferably the majority, preferably substantially all of the gaps of the individual reinforcing fibers f in the load bearing member 10 are filled with the polymer of the matrix m. As above mentioned, the matrix m of the load bearing member 10 is most preferably hard in its material properties. A hard matrix m helps to support the reinforcing fibers f, especially when the rope bends, preventing buckling of the reinforcing fibers f of the bent rope, because the hard material supports the fibers f. To reduce the buckling and to facilitate a small bending radius of the rope, among other things, it is therefore preferred that the polymer matrix is hard, and in particular non-elastomeric. The most preferred materials are epoxy resin, polyester, phenolic plastic or vinyl ester. The polymer matrix is preferably so hard that its module of elasticity (E) is over 2 GPa, most preferably over 2.5 GPa. In this case the module of elasticity (E) is preferably in the range 2.5-10 GPa, most preferably in the range 2.5-3.5 GPa. There are commercially available various material alternatives for the matrix m which can provide these material properties. Preferably over 50% of the surface area of the cross-section of the load bearing member is of the aforementioned reinforcing fiber, preferably such that 50%-80% is of the aforementioned reinforcing fiber, more preferably such that 55%-70% is of the aforementioned reinforcing fiber, and substantially all the remaining surface area is of polymer matrix. Most preferably, this is carried out such that approx. 60% of the surface area is of reinforcing fiber and approx. 40% is of matrix material (preferably epoxy material). In this way a good longitudinal stiffness for the load bearing member is achieved.

As mentioned, each said sensor is arranged to generate a sensor signal representing sensed code marks, and said code mark pattern 5 is formed to be such that the sensor signal generated by said one or more sensor 6 can be interpreted by the analyzer 7 for said determination of current car position. This can be implemented in alternative ways. Preferably, the code mark pattern 5 and the one or more sensors 6 are configured to function together either as an incremental encoder or as an absolute encoder, which are both widely known types of encoders.

FIGS. 10 and 12 illustrate each a case wherein the code mark pattern 5 and the one or more sensors 6 are configured to function together as an incremental encoder. When utilizing principles of incremental encoder, it is preferable that in the method for determining current car position based on code marks 5*a* sensed by the one or more sensors 6 during said movement of the rope the analyzing means are configured to obtain a car reference position, such as an earlier position, e.g. from a position sensor directly sensing car position, and to determine change in car position based on code marks sensed by the sensing device during rope movement; and to sum up said change in car position and the car reference position. In case where the principle of incremental encoder is to be used, at simplest, the analyzer can be arranged to count code marks sensed by a sensor during rope movement and to calculate the change of car position by multiplying the counted number of code marks with the distance between code marks. FIG. 10 illustrates a very simple configuration, but it is possible that a more sophisticated configuration is used. For example, more than one 'channel' can be used as it is known in the field of encoders. FIG. 12 illustrates this type of configuration. In this case plural sensors 6 which are displaced in longitudinal direction of the rope and the pattern 4 are arranged to sense same code marks 5*a* of said code mark pattern 5 and generate separate sensor signals each representing code marks sensed by the sensor in question, the sensor signals generated by these plural sensor 6 can be interpreted by the analyzer 7 for said determination of current car position. By this more sophisticated configuration, more information can be obtained by analyzing the plural signals generated from the same code marks 5*a* of the pattern 5. In the example of FIG. 12, displacement of the sensors enables that the plural channels can be utilized for deducing running direction of the rope, for example.

FIGS. 11 and 13 illustrate each an implementation following the principle of absolute encoder. Thus, here the code mark pattern 5 and the one or more sensors 6 are configured to function together as an absolute encoder. As showed in FIGS. 11 and 13, the pattern 5 comprises plural series A,B; A,B,C,D of code marks adjacent each other in width direction of the rope r,r', and each series is sensed by a different sensor 6. The sensors generate separate sensor signals each signal representing code marks sensed by the sensor in question. The sensor signals generated by these plural sensor 6 by sensing the plural adjacent series, can be interpreted by the analyzer 7 for said determination of current car position. In this case where the principle of absolute encoder is to be used, the pattern has been formed such that the period of sensor signals generated by code marks of any point of the rope or section of the rope is unique and associated with a unique indicator of car position. Thus, the analyzer 7 can obtain the car position from the rope sensor signals 6 without reference data, which is useful e.g. if the position needs to be determined after power loss or any other situation where reference data is not readily available.

In the application, preferred material and shape options for the rope have been described. In the broad sense of the invention, it is however obvious that the particular shape and material options disclosed are advantageous but not necessary, as alternatively some other shape and/or material could be used.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. An elevator comprising:

a hoistway;

an elevator car vertically movable in the hoistway;

a rope connected to the elevator car movably together with the elevator car;

guiding means for guiding the rope along a path; and means for determining position of the elevator car, said means for determining position of the elevator car comprising:

an elongated code mark pattern provided on the rope, which elongated code mark pattern comprises code marks distributed along a length of the rope;

a plurality of sensors mounted beside the rope for sensing the code marks of said code mark pattern, the plurality of sensors being spaced in a width direction and a length direction of the rope and being configured to generate separate sensor signals, wherein the spacing in the length direction enables determination of a running direction of the rope; and an analyzer connected with the plurality of sensors, wherein the plurality of sensors are arranged to sense the code marks of the code mark pattern passing by them when the rope moves along its path, and said analyzer is configured to determine current position of the elevator car based on the code marks sensed by the plurality of sensors during movement of the rope.

2. The elevator according to claim 1, wherein the plurality of sensors are mounted on a stationary structure of the elevator.

3. The elevator according to claim 1, wherein each said sensor is arranged to generate a sensor signal representing sensed code marks, and said code mark pattern is formed to be such that respective sensors signals generated by the plurality of sensors can be interpreted by the analyzer for the determination of current car position.

4. The elevator according to claim 1, wherein the rope comprises one or more load bearing members extending parallel with the longitudinal direction of the rope unbroken throughout the length of the rope.

5. The elevator according to claim 1, wherein the one or more load bearing members are made of composite material comprising reinforcing fibers embedded in polymer matrix, which reinforcing fibers are carbon fibers.

6. The elevator according to claim 5, wherein said one or more load bearing members as well as said reinforcing fibers are oriented parallel with the longitudinal direction of the rope.

7. The elevator according to claim 1, wherein the rope is belt-shaped, whereby it is substantially larger in the width direction than in a thickness direction, and the elongated code mark pattern is provided on a wide side of the rope.

8. The elevator according to claim 1, wherein the rope has a width per thickness ratio W/T more than 2.

9. The elevator according to claim 1, wherein said plurality of sensors are focused on a wide side of the belt-shaped rope to sense code marks of the code mark pattern provided thereon.

10. The elevator according to claim 1, wherein the guiding means comprise one or more rope wheels around which the rope is arranged to pass turning around an axis extending in the width direction of the rope.

11. The elevator according to claim 1, wherein said one or more load bearing members are embedded in a coating.

12. The elevator according to claim 11, wherein said elongated code mark pattern is comprised in an elongated code mark strip comprised in the rope.

13. The elevator according to claim 12, wherein the elongated code mark strip is attached on the outer surface of the coating of the rope.

14. The elevator according to claim 12, wherein the elongated code mark strip is embedded in the coating of the rope.

15. The elevator according to claim 14, wherein the coating of the rope comprises a first coating portion wherein the one or more load bearing members are embedded, and the strip is provided outside the first coating portion and is covered by a second coating portion outside the first coating portion, and wherein the second coating portion is different than the first coating portion.

16. The elevator according to claim 15, wherein the coating is transparent such that the strip is visible from outside the rope through said coating.

17. The elevator according to claim 1, wherein the guiding means comprise one or more rope wheels around which the rope is arranged to pass, and the plurality of sensors are focused to sense code marks provided on a rope section resting against the one or more rope wheels.

18. The elevator according to claim 1, wherein the rope is belt-shaped, and the elongated code mark pattern is provided on a wide side of the rope, and the guiding means comprise one or more rope wheels around which the rope is arranged to pass turning around an axis extending in the width direction of the rope, the same wide side of the rope resting against the circumference of each of the rope wheels around which the rope is arranged to pass, which same wide side of the rope is opposite to the wide side on which the elongated code mark pattern is provided.

19. The elevator according to claim 11, wherein the coating is a polymer coating.

20. The elevator according to claim 1, wherein the elongated code mark pattern comprises a plural series of code marks located adjacent each other in the width direction of the rope.

* * * * *